US005400526A

United States Patent [19]

Sessa

[11] Patent Number: 5,400,526

[45] Date of Patent: Mar. 28, 1995

[54] FOOTWEAR SOLE WITH BULBOUS PROTRUSIONS AND PNEUMATIC VENTILATION

[76] Inventor: Raymond V. Sessa, 5123 Quail Dr., S., Grand Rapids, Mich. 49546

[21] Appl. No.: 120,904

[22] Filed: Sep. 14, 1993

[51] Int. Cl.[6] ..... A43B 7/06

[52] U.S. Cl. ..... 36/3 B; 36/3 R; 36/141

[58] Field of Search ..... 36/3 R, 3 B, 29, 35 B, 36/141, 147, 43, 44

[56] References Cited

U.S. PATENT DOCUMENTS

| | | | |
|---|---|---|---|
| 1,852,883 | 4/1932 | Gustaveson . | |
| 2,010,151 | 8/1935 | Helwig . | |
| 2,098,412 | 11/1937 | Bovay | 36/3 R |
| 2,327,360 | 8/1943 | Margolin | 36/3 B |
| 2,441,879 | 5/1948 | Gantt . | |
| 2,558,973 | 7/1951 | Meaker | 36/3 B |
| 3,012,342 | 12/1961 | Ramirez . | |
| 3,225,463 | 12/1965 | Burnham . | |
| 3,426,455 | 2/1969 | Drago . | |
| 3,475,836 | 11/1969 | Brahm . | |
| 3,624,930 | 12/1971 | Johnson et al. . | |
| 4,012,854 | 3/1977 | Berend et al. . | |
| 4,063,371 | 12/1977 | Batra | 36/3 B |
| 4,075,772 | 2/1978 | Sicurella . | |
| 4,078,321 | 3/1978 | Famolare, Jr. . | |
| 4,102,061 | 7/1978 | Saaristo | 36/3 B |
| 4,124,946 | 11/1978 | Tomlin | 36/43 |
| 4,215,492 | 8/1980 | Sandmeier | 36/3 B |
| 4,223,455 | 9/1980 | Vermeulen . | |
| 4,263,728 | 4/1981 | Frecentese . | |
| 4,319,412 | 3/1982 | Muller et al. . | |
| 4,438,573 | 3/1984 | McBarron . | |
| 4,468,869 | 9/1984 | Fukuoka | 36/3 R |
| 4,499,672 | 2/1985 | Kim . | |
| 4,547,978 | 10/1985 | Ranford . | |
| 4,602,441 | 7/1986 | El Sakkaf . | |
| 4,610,099 | 9/1986 | Signori . | |

(List continued on next page.)

FOREIGN PATENT DOCUMENTS

| | | | |
|---|---|---|---|
| 1432811 | 2/1966 | France . | |
| 2226216 | 12/1973 | Germany | 36/3 B |
| 3330060A | 2/1985 | Germany . | |
| 3432-629A | 3/1986 | Germany . | |
| 16143 | of 1894 | United Kingdom | 36/3 R |
| 2165439 | 4/1986 | United Kingdom | 36/3 B |
| 2193426 | 2/1988 | United Kingdom . | |
| WO81/02828 | 10/1981 | WIPO . | |
| 8603951 | 7/1986 | WIPO | 36/3 B |

*Primary Examiner*—Steven N. Meyers
*Attorney, Agent, or Firm*—Waters & Morse

[57] ABSTRACT

A sole for an article of footwear includes a heel area, an arch area, and a ball area, each defined on the top surface and corresponding to the respective areas of the foot. Each of the areas has a plurality of bulbous protrusions extending upwardly to contact the respective areas of the foot. A toe area is also defined on the top surface including a plurality of cavities in anatomical relation to the toes of the foot. The sole also has an air passage disposed between the top surface of the sole and the bottom surface of the sole. A plurality of upwardly extending sections connect the air passage to the top surface of the sole. The upwardly extending sections are disposed about the top of the sole between the bulbous protrusions and communicate ambient air surrounding the sole with ambient air above the top surface of the sole through repeated compression and expansion of the air passage. A liquid barrier is also inserted within the front and rear sections of the air tunnel for prohibiting contamination by dirt or liquid. The sole is formed from an abrasion resistant outer sole with a recess in the top surface, with an insert of a softer material fitting in the recess and forming the air tunnels therebetween. An insole fits on the outer sole and insert, the bulbous protrusion being on the upper surface of the insole.

9 Claims, 6 Drawing Sheets

U.S. PATENT DOCUMENTS 4,617,745 10/1986 Batra .
4,633,597 1/1987 Shiang .
4,654,982 4/1987 Lee .
4,666,646 5/1987 Chang .
4,674,203 6/1987 Goller .
4,685,224 8/1987 Anger ..... 36/3 B
4,760,651 8/1988 Pon-Tzu .
4,763,426 8/1988 Polus et al. .
4,771,555 9/1988 Ohashi ..... 36/3 R
4,776,110 10/1988 Shiang .
4,813,160 3/1989 Kuznetz .
4,817,304 4/1989 Parker et al. .
4,835,883 6/1989 Tetrault et al. .
4,841,647 6/1989 Turucz .
4,860,463 8/1989 Pin .
4,910,882 3/1990 Goller .
4,918,838 4/1990 Chang .
4,934,071 6/1990 Virgini .
4,934,072 6/1990 Fredericksen et al. .
4,993,173 2/1991 Gardiner ..... 36/3 B
5,010,661 4/1991 Chu .
5,010,662 4/1991 Dabuzhsky et al. .
5,035,068 7/1991 Biasi .
5,044,096 9/1991 Polegato ..... 36/3 B
5,150,490 9/1992 Busch et al. ..... 36/43
5,199,191 4/1993 Moumdjian .

FOOTWEAR SOLE WITH BULBOUS PROTRUSIONS AND PNEUMATIC VENTILATION

BACKGROUND OF THE INVENTION

The present invention relates to soles for use with articles of footwear. More particularly, the present invention relates to soles having a plurality of bulbous protrusions and providing pneumatic ventilation to the foot.

Since man has begun wearing shoes to protect his feet, he has continually strived for increased comfort. Not surprisingly, his efforts have been continually directed toward improvements in the sole of the shoe. Efforts to improve the sole of the shoe have included softer materials, anatomical shapes, and means for aerating the feet. However for the most part, these efforts have remained isolated from one another.

Various patents have sought to aerate the feet through a plurality of channels interspersed within the shoe sole. A representative example is Batra, U.S. Pat. No. 4,617,745 in which air channels provide a flow of air to the foot through a multiplicity of holes. While an air inlet is provided at the instep of the sole, no means other than the placement of the air inlet is provided for resisting contamination from water or dirt. The French patent to Pradet, French Patent No. 1,432,811 incorporates a different canal design while encountering similar problems.

Various patents have also attempted to provide sufficient flexibility and resiliency in a shoe sole through the incorporation of air chambers. Vermeulen, U.S. Pat. No. 4,223,455 discloses a plurality of air chambers having a generally round configuration. Parker et al., U.S. Pat. No. 4,817,304 discloses a cushioning sole structure including a sealed inner member inflated with a gaseous medium. These types of air chambers generally provide support to the foot but fail to provide a means for aerating the foot. Additionally, these types of air chambers are quite complicated and difficult to manufacture.

Some patents have attempted to massage the foot or provide increased health through the strategic placement of undulating tabs. Turucz, U.S. Pat. No. 4,841,647 discloses a plurality of convex tabs to massage the soles of the feet during walking. These tabs correspond to the acupressure zones of the foot. The German patent to Ellrich, DE 33,30,060,A1 discloses a plurality of sole inserts consisting of two different metals. Under contact with perspiration, the two metals provide therapeutic properties due to galvanic action. Patents such as these fail to provide adequate aeration of the feet and also fail to take advantage of the latest materials.

A few patents have attempted to combine a means for aeration along with massaging support columns. Biasi, U.S. Pat. No. 5,035,068 discloses a plurality of compressible support columns to stimulate the lower portions of the wearer's foot. A pair of collapsible valves allow air to be forced through the spaced columns and then through a perforated anatomical sock. Biasi, however, fails to provide a means for preventing liquid from entering the pair of collapsible valves.

Göller, U.S. Pat. No. 4,910,882 discloses an aerating and massaging insole which combines a plurality of ribs with a perforated base. While contact of the foot with the ribs seeks to massage the foot, air may penetrate the perforated base. Göller does not provide a means for fresh air to enter the shoe cavity. Although Göller and Biasi seek to provide a massaging action to the foot, the effectiveness of this action is compromised by the insertion of a perforated layer above the massaging means.

Pon-Tzu, U.S. Pat. No. 4,760,651 discloses a shoe pad having an air blowing compression chamber which connects to the external air by a modified permanent shoe horn. Convex grains having a circular shape are disposed on the top of the shoe pad to massage the foot and separate the wearer's foot from the shoe pad. However, this shoe pad is designed to retrofit an existing shoe structure and does not appear to communicate air from the shoe sole directly to an ambient air source.

SUMMARY OF THE INVENTION

The present invention seeks to overcome the disadvantages of the prior art through a sole for an article of footwear having a plurality of bulbous protrusions. The sole includes a heel area, an arch area, and a ball area, each defined on the top surface and corresponding to the respective areas of the foot. Each of the areas has a plurality of bulbous protrusions extending upward to contact the foot. The bulbous protrusions are generally wide and dome shaped to provide a gentle massaging action to the bottom of the foot. A toe area is also defined on the top surface of the sole for providing support to the toes of the foot. The toe area includes a plurality of cavities designed in anatomical relation to the toes of the foot.

The present invention also overcomes the disadvantages of the prior art for aerating the feet. The sole has an air passage disposed between the top surface of the sole and the bottom surface of the sole. The air passage has a front section extending forwardly to contact the front side and a rear section extending rearwardly to contact the rear side. A plurality of upwardly extending sections connect the air passage to the top surface. The upwardly extending sections are disposed about the top of the sole between the bulbous protrusions. The air passage communicates ambient air surrounding the front side of the sole with ambient air above the top surface of the sole through repeated compression and expansion of the air passage during walking. The bulbous protrusions assist in this communication by preventing the blockage of the upwardly extending sections by the foot. A means is also insertable within the front and rear sections of the air tunnel for prohibiting contamination of the air tunnel by dirt or liquid.

Various advantages and features of novelty which characterized the invention are pointed out with particularity in the claims annexed hereto and forming a part hereof. However, for a better understanding of the invention, its advantages, and objects obtained by its use, reference should be made to the drawings which form a further part hereof, and to the accompanying descriptive matter, in which there is illustrated and described preferred embodiments of the invention.

DETAILED DESCRIPTION OF THE PREFERRED EMBODIMENT

Figure 1:
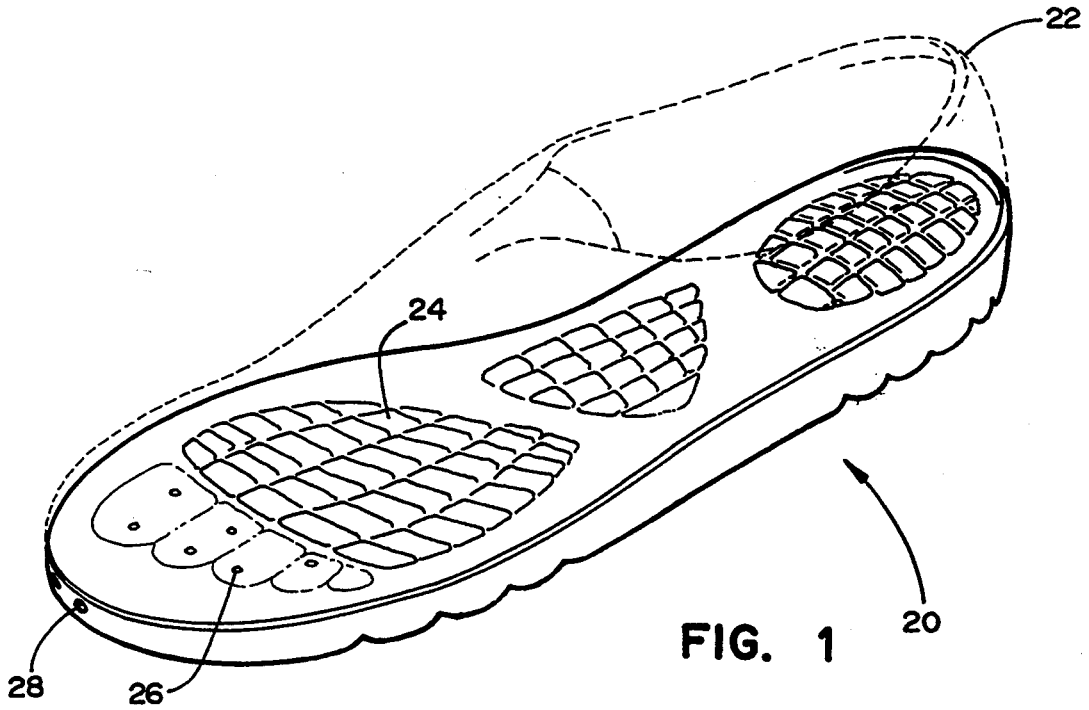
FIG. 1 is a perspective view of a footwear sole showing the outline of a shoe upper.

Referring now to the drawings, and, more particularly to FIG. 1, a perspective view of a footwear sole 20 in accordance with the present invention is shown. While footwear sole 20 may be used for a variety of applications including boots, sandals and athletic shoes, the inventive concepts of the present invention are preferably embodied in a casual walking shoe. In this regard, a shoe upper 22 is shown in phantom to indicate relative placement with respect to footwear sole 20.

Footwear sole 20 is shown with a plurality of bulbous protrusions 24 disposed upon the top surface thereof. A plurality of air ducts 26 are connected to a plurality of air tunnels which are formed within the footwear sole. These air tunnels communicate with the outside of footwear sole 20 through a pair of front exit openings 28 and rear exit openings 40. Through a walking action of the wearer upon footwear sole 20, the air tunnels are sequentially contracted and expanded to draw air in through front exit openings 28 then into shoe upper 22 via air ducts 26. Through this action, it is contemplated that the feet will remain relatively dry and that moisture will be removed from the foot.

Figure 2:
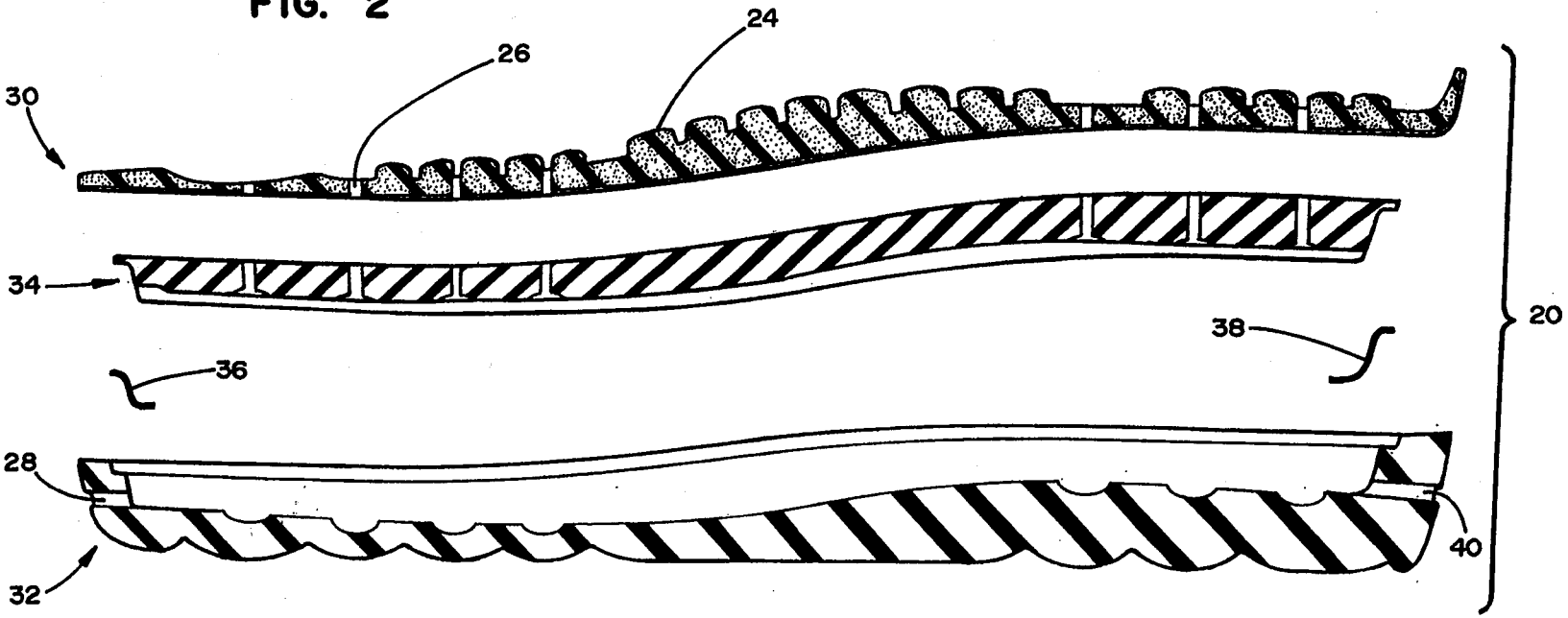
FIG. 2 is an exploded sectional view of the outsole, insert, liquid barrier and insole.

In reference to FIG. 2, an exploded sectional view of footwear sole 20 is shown. Footwear sole 20 includes insole 30 which contacts outsole 32 to enclose insert 34 therein. As shown in FIG. 2, front liquid barrier 36 and rear liquid barrier 38 are disposed between insert 34 and outsole 32. Front liquid barrier 36 prevents liquid from entering the interior of footwear sole 20 via front exit opening 28 and rear liquid barrier 38 prevents liquid from entering the interior of footwear sole 20 via rear exit opening 40. Both liquid barriers 36 and 38 allow the penetration of air but resist the penetration of liquid and other debris.

Figure 3:
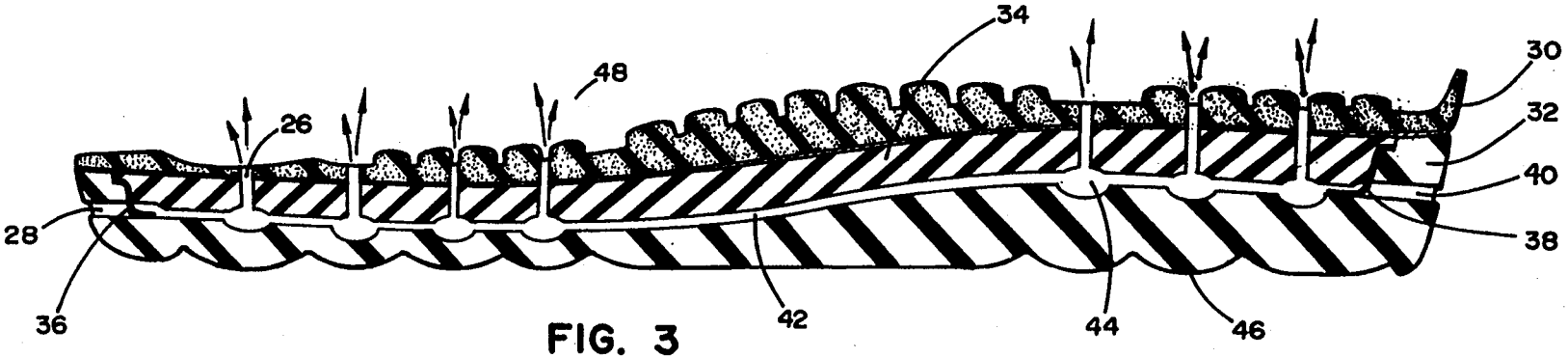
FIG. 3 is a sectional view along the longitudinal axis with outsole, insert, barrier and insole shown together.

FIG. 3 shows insole 30, outsole 32 and insert 34 disposed in an assembled compressed relation. As shown by FIG. 3, air tunnel 42 connects front exit opening 28 and rear exit opening 40 to the air ducts 26. Air ducts 26 are shown passing through insole 30 and insert 32 to connect to air tunnel 42. Interspersed along the length of air tunnel 42 at the ends of ducts 26 are a plurality of air bellows 44. Air bellows 44 compress and expand to draw air from front exit openings 28 and rear exit openings 40 and to expel air out through air ducts 26.

The underside of outsole 32 is configured so that a plurality of exterior nubs 46 generally coincide with the air bellows 44. This configuration of exterior nubs 46 accentuates the compression and expansion of air bellows 44 to direct air through air ducts 26. In practice, however, it is contemplated that insert 34 is made from a softer material than outsole 32. This allows outsole 32 to be made from a material which is sufficient in hardness to resist wear through walking. Insert 34 is then allowed to be made of a soft material which may readily deform to compress bellows 44. This will assist in the direction of air through air ducts 26. The output of air 48 is representatively shown above air ducts 26 for aerating the feet.

Figure 4:
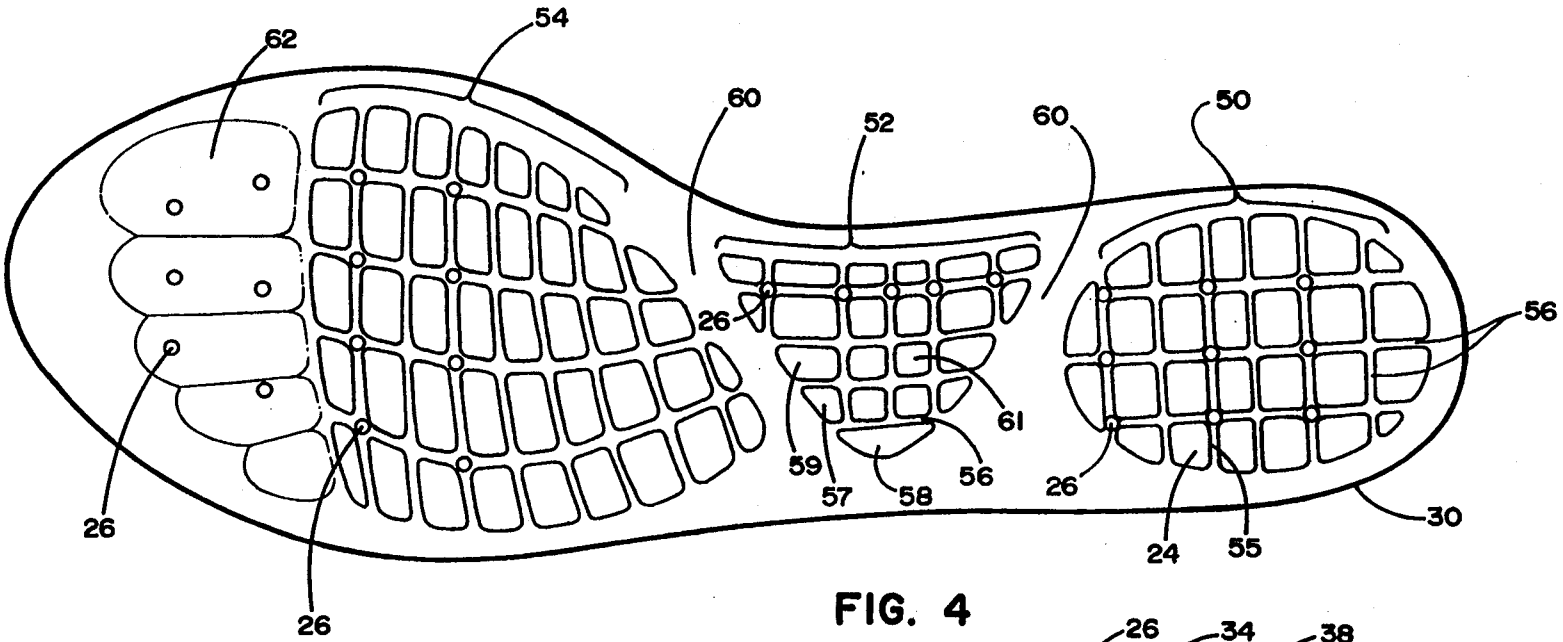
FIG. 4 is a top view of the insole showing a plurality of bulbous protrusions interspersed with a plurality of air holes.

FIG. 4 shows the top side of footwear sole 20 or, more particularly, the top side of insole 30. From FIG. 4, a preferred embodiment for the layout of bulbous protrusions 24 is shown. Additionally, air ducts 26 are shown interspersed between bulbous protrusions 24 for effectuating the dispersement of air. Bulbous protrusions 24 allow air from air ducts 26 to circulate underneath the foot by preventing full contact of the foot with the upper surface of insole 30.

Bulbous protrusions 24 are arranged in generally three sections, namely: heel section 50, arch section 52 and ball section 54. Each of the sections respectively correspond to the heel area, arch area, and ball area of the foot. Heel section 50 of the bulbous protrusions 24 is generally elliptical in nature with each of the protrusions arranged in a generally grid-like fashion. The grid-like arrangement of heel section 50 forms a plurality of canals 56 for the transportation of air. Each of the bulbous protrusions 24 has at least one coacting side 55 for coacting with another bulbous protrusion 2.4 to form said canals. It is apparent from reference to FIG. 4 that in the preferred embodiment, heel section 50 has bulbous protrusions with two to four coacting sides 55.

Arch section 52 also provides a plurality of bulbous protrusions 24 which are formed in orthopedic relation to the arch of a human foot. As shown from FIG. 4 in combination with insole 30 of FIG. 2, bulbous protrusions 24 of arch section 52 are generally raised to conform to the arch of the human foot. These protrusions 24 form a plurality of canals 56 to assist in the transportation of air therein. With specific reference to curved protrusion 58, it is shown that a protrusion may have a single linear side coacting with other protrusions to form a canal. Protrusions 57, 59 and 61 respectively show that the bulbous protrusions 24 may have two, three or four coacting sides 55. Arch section 52 is generally triangular in shape with curved vertices; however, it may be arrowhead shaped or formed in any other orthopedic relation to the arch of the foot.

Ball section 54 of insole 30 likewise discloses a plurality of bulbous protrusions in near grid-like relation. Canals 56 are formed between protrusions 24 for assisting in the circulation of air. Rows of bulbous protrusions in ball section 54 are generally rectangular nearer the toe section of the insole 30 but converge slightly as progression is made towards the arch section 52 of the insole. This better conforms to the orthopedic relation of the foot.

Sectional valleys 60 are disposed between ball section 54 and arch section 52 and also between arch section 52 and heel section 50. Section valleys 60 function in the same manner as canals 56 but on a much larger scale to assist in the communication of air about the bottom of the foot. Sectional valleys 60 may be of different depth than canals 56 but are preferably of the same depth.

Insole 30 does not provide bulbous protrusions about the toe area of the foot. Instead, insole 30 provides a plurality of toe cavities 62 each corresponding in anatomical relation to the toes of the foot. Toe cavities 62 also include a plurality of air ducts 26 for assisting in the aeration of the toes. While it is contemplated by the present invention that bulbous protrusions may extend into the toe area of the foot, it is found that toe cavities 62 provide greater comfort to the wearer during walking. Additionally, since little weight is placed upon the toe areas of the foot in relation to the other areas, such as the ball area and the heel area, the provision of canals 56 to assist in circulation of air is not as needed.

Figure 6:
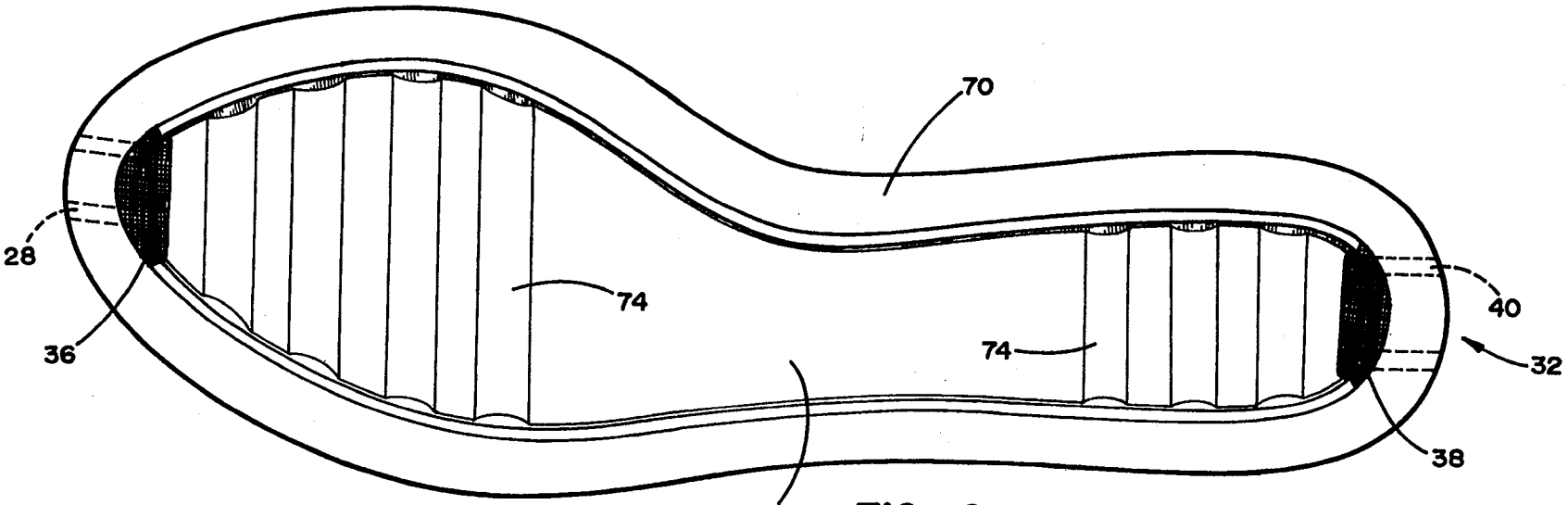
FIG. 6 is a top view of the outsole.
Figure 5:
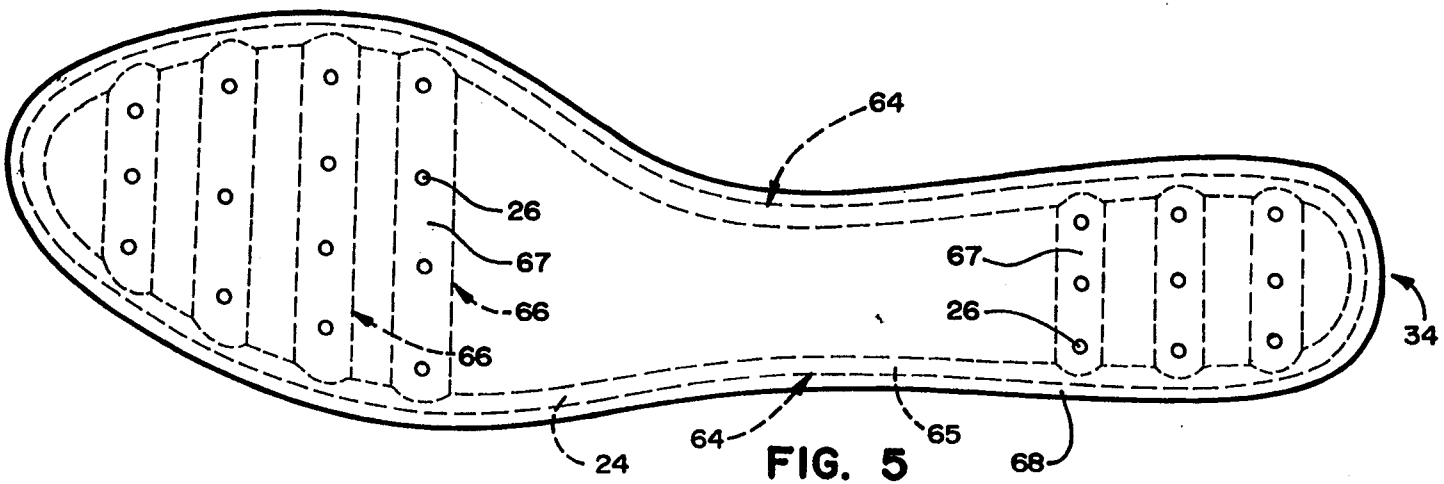
FIG. 5 is a top view of the insert.
Figure 7:
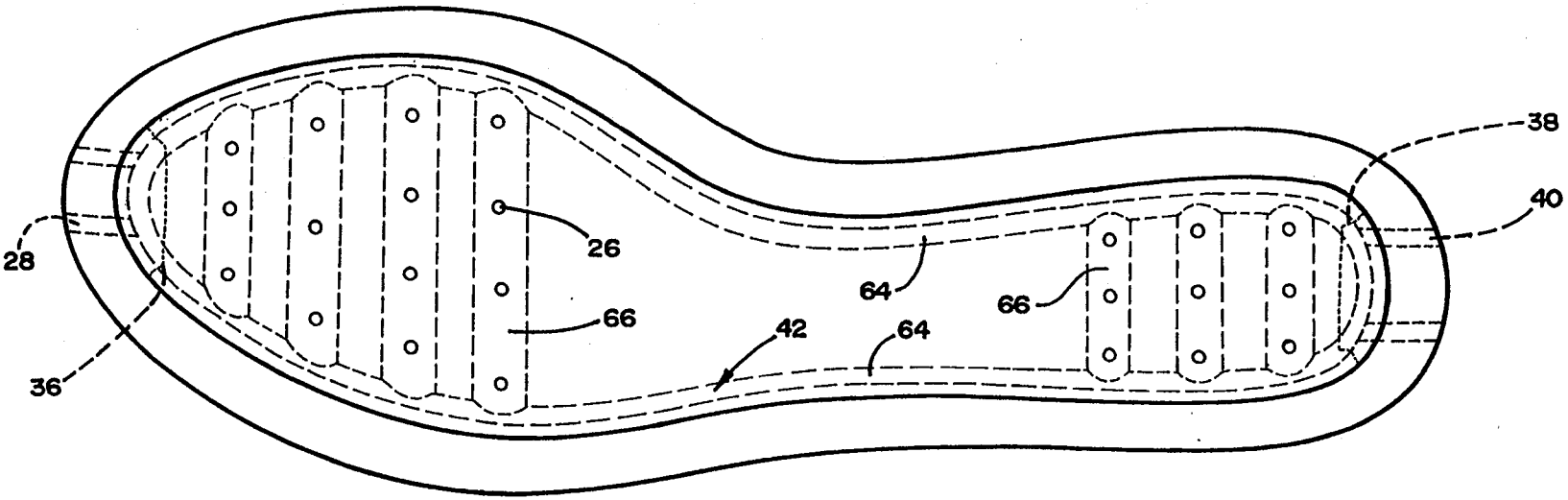
FIG. 7 is a top view of the outsole an insert showing the air passages.

FIGS. 5, 6 and 7 respectively disclose the insert 34, outsole 32 and a combination thereof. In FIG. 5, insert 34 shows the layout of the plurality of air ducts 26. Air tunnel 42 is shown comprised of longitudinal air tunnels 64 and lateral air tunnels 66. Each of these air tunnels 64 and 66 seeks to communicate air between exit openings 28 and 40 and air ducts 26.

As shown in FIG. 5, each of the air tunnels 64 and 66 has inverted troughs 65 and 67 respectively disposed along the bottom side of insert 34. Longitudinal air tunnels 64 and lateral air tunnels 66 connect to communicate the passage of air there between. Longitudinal air tunnels 64 actually surround the periphery of insert 34, connecting at the front toe area and the rear heel area. Sealing rim 68 surrounds the periphery of longitudinal air tunnel 64 and provides a means for sealing insert 34 with respect to outsole 32.

FIG. 6 shows outsole 32 having outsole rim 70 disposed about the periphery thereof. Outsole cavity 72 is defined within the outsole rim 70. A plurality of complements 74 appear as noninverted troughs to form the lower portion lateral air tunnels 64. Complements 74 are configured to coincide with inverted troughs 67 of insert 34. Inverted troughs 67 and lateral air trough complements 74 coact to define lateral air tunnels 66, which provides a passageway to communicate air between air ducts 26 and longitudinal air tunnels 64. A pair of front exit openings 28 pass through outsole rim 70 to outsole cavity 72. Likewise, rear exit openings 40 pass through outsole rim 70 into the interior of outsole cavity 72. While lateral air troughs 67 and lateral air trough complements 74 coact to define lateral air tunnels 66, the front exit openings 28 and rear exit openings 40 are formed entirely within outsole rim 70. In further reference to FIG. 6, front liquid barrier 36 and rear liquid barrier 38 are shown in respective relation to front exit openings 28 and rear exit openings 40 to allow the passage of air therethrough but impede the passage of liquid.

FIG. 7 shows insert 34 and outsole 32 together as a single unit. This more clearly shows the plurality of air tunnels 42 along with the plurality of air ducts 26.

Figure 8:
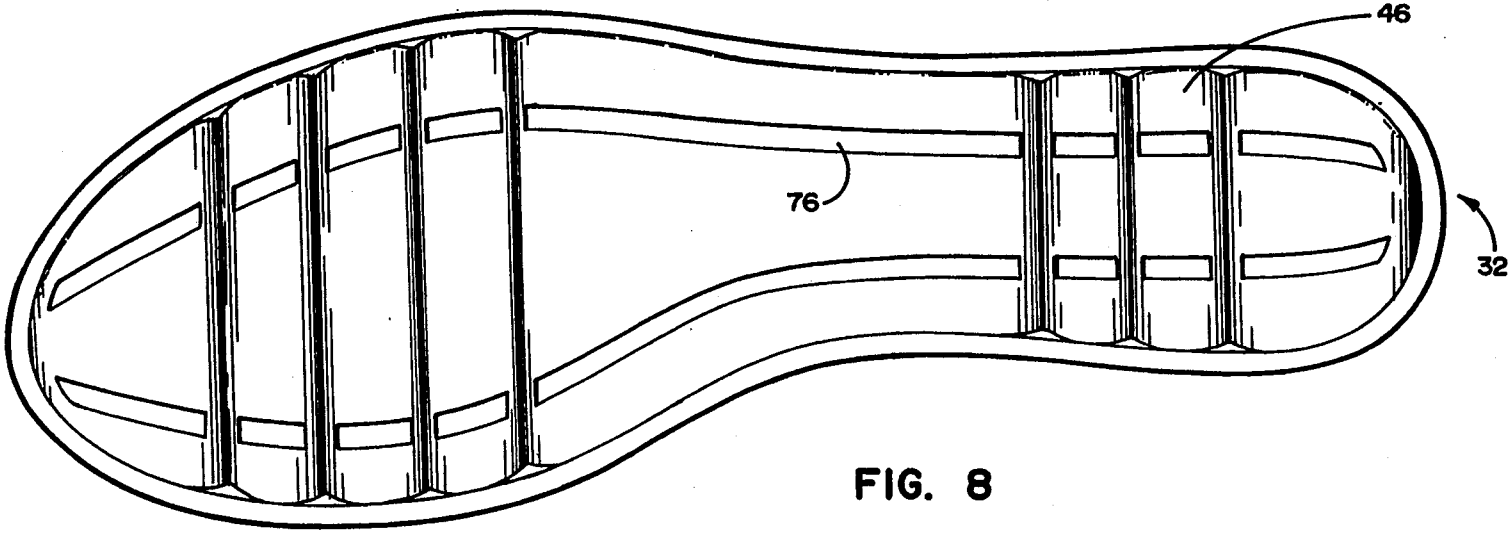
FIG. 8 is a bottom view of the outsole.

FIG. 8 shows the bottom side of outsole 32, with the plurality of exterior nubs 46. Pattern 76 formed in the outsole generally conforms to the interior layout of longitudinal air tunnels 64.

Figure 10:
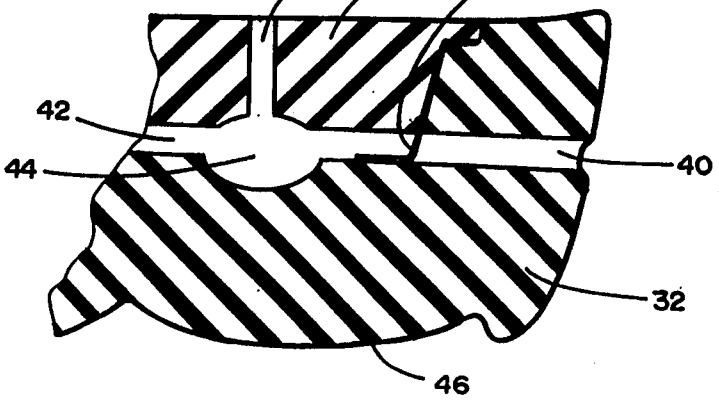
FIG. 10 is an enlarged sectional view of the rear portion of the footwear sole.
Figure 9:
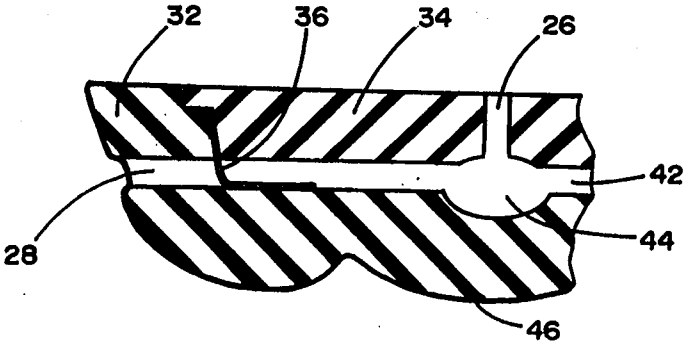
FIG. 9 is an enlarged sectional view of the front portion of the footwear sole.

FIG. 9 and 10 each respectively show an enlarged sectional view of the front and rear portion of footwear sole 20. Front liquid barrier 36 and rear liquid barrier 38 respectively cover front exit openings 28 and rear exit openings 40 to prevent the entrance of liquid therein.

While insole 30 may be made from a variety of materials to accomplish the objectives of the present invention, the preferred embodiment incorporates a light weight, polyurethane foam having an open cell construction. In an open cell construction, millions of minute pores or air bubbles are formed in light weight polyurethane. This allows air to circulate freely through the insole. The open cell construction is formed by adding chemical agents to the polyurethane base materials which results in ionization. These pores are generally invisible to the naked eye but are readily apparent with the aid of a microscope. The open cell construction assists the ready evaporation of moisture from the foot. To allow this evaporation, insole 30 should have a water absorption rate of 8 to 12 mg/cm$^2$/hr. This is considerable when compared with other materials such as EVA 15 mg/cm$^2$/hr.; latex 0.9 mg/cm$^2$/hr.; and foam rubber 0.1 mg/cm$^2$/hr. It is also contemplated that certain biocides and activated carbon may be mixed into the light weight polyurethane foam to help diminish the environment in which bacteria and fungus may grow. This would have the added benefit of reducing odor and resisting athletes foot and other afflictions. It is contemplated that a light weight polyurethane foam having an open cell construction for use with the present invention may be made according to the method disclosed in Chang in U.S. Pat. No. 4,666,646.

Figure 11:
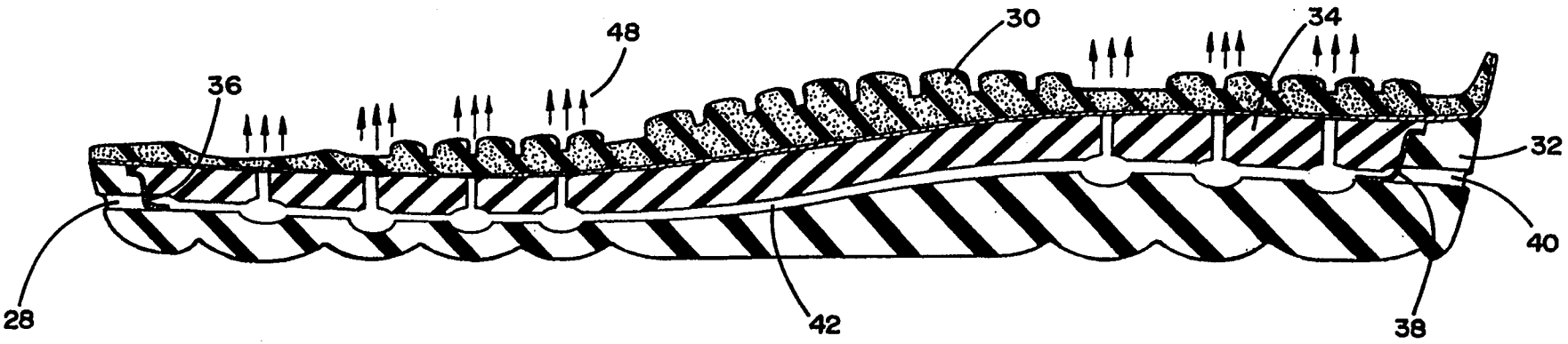
FIG. 11 is a sectional view of the footwear sole along the longitudinal axis without air passages in the insole.

In an alternative embodiment, insole 30 does not contain a plurality of air ducts 26 but simply relies upon the open cell structure in combination with the plurality of air tunnels 42. This is shown in FIG. 11 which is a sectional view taken along the longitudinal axis of the shoe. It is contemplated that air 48 will penetrate insole 30 more slowly but have a more even dispersement of air throughout.

Outsole 32 is preferably made from a thermoplastic rubber or TPR. TPR is formed by heating the substance past its melting point and then injecting it into a mold. As the substance cools, it hardens into the shape of the mold. TPR has very little air intermixed with the substance. The density of the material is on the order of 85% to 90%. Outsole 32 could be made from a variety of materials including polyvinylchloride. However, it is preferably made from TPR having a durometer hardness of 60–64 on the Shore type A scale. The Shore type A scale varies from 0–100 with 0 representing no hardness and 100 representing the hardness of steel. TPR with a 60–64 durometer hardness has the preferred resiliency and abrasion resistance.

Insert 34 may also be made from a variety of materials including TPR but is preferably made from closed cell polyurethane. Polyurethane is made from a combination of separate liquids which react to form a polyurethane foam. Polyurethane resembles bread in that a foam interior is surrounded at the periphery by a polyurethane "crust" or "skin". This skin is substantially harder than the interior foam which makes testing via a durometer impractical.

Polyurethane generally has a closed cell configuration and is usually measured as a percentage of weight to volume or density. The closed cell configuration indicates that the foam includes a plurality of encapsulated air pockets which do not communicate air with other air pockets. For insert 34, the preferred density of closed cell polyurethane is on the order of 53–57%.

Front liquid barrier 36 and rear liquid barrier 38 are preferably made from a polypropylene fabric which has been treated with a flurochemical spray. A number of flurochemical sprays will work with the present invention. A representative example is sold under the trademark SCOTCHGUARD by The 3M Company. This fabric and spray combination has the characteristic of vapor permeability with considerable water-resistant properties. Such material will also prevent solid objects, such as dirt and small pebbles, from entering air tunnels 42.

Numerous characteristics, advantages and embodiments of the invention have been described in detail in the foregoing description with reference to the accompanying drawings. However, the disclosure is illustrative only, and the invention is not limited to the precise illustrated embodiments. Various changes and modifications may be effected therein by one skilled in the art without departing form the scope or spirit of the invention, which is defined in the following claims.

I claim:

1. A sole for an article of footwear having a top surface, a bottom surface, a side connecting the top surface and the bottom surface and an air tunnel disposed between the top surface and the bottom surface exiting to a source of ambient air through the side, the sole comprising:

an insole having a bottom surface and a top surface, a plurality of bulbous protrusions being formed on the top surface of the insole, the bulbous protrusions extending upwardly from the top of the insole and form a plurality of canals between adjacent bulbous protrusions; and an outsole having a top surface configured to form a continuous relation with the bottom surface of the insole and having a bottom surface for contracting a walking surface, the outsole comprising an outer shell having an interior cavity and an insert so configured and arranged to snugly fit within the outer shell cavity, the air tunnel being formed between the outer shell and the insert by means of canals formed in the mating surfaces of the outer shell and insert, the outer shell cavity forming a lower side of the air tunnel and said insert forming an upper side of the air tunnel;

the sole having a plurality of upwardly extending air outlet passageways through the insert and insole connecting the air tunnel to the top surface of the sole.

2. The sole for an article of footwear according to claim 1, wherein each of said bulbous protrusions has at least one side in nearly parallel relation with the side of another bulbous protrusion.

3. The sole for an article of footwear according to claim 1, wherein a toe area of the sole includes a plurality of cavities each corresponding to a toe of the foot.

4. The sole for an article of footwear according to claim 3 wherein the toe cavities do not contain any bulbous protrusions.

5. A sole for an article of footwear according to claim 1, wherein said upwardly extending passageways are positioned so as to have outlets in the canals between the bulbous protrusions, the canals providing a means to channel air over the upper surface of the sole.

6. The sole of an article of footwear according to claim 5 further comprising:

an air tunnel rear inlet opening in a rear side of the sole, the rear inlet opening providing communication between ambient air surrounding the rear side of the sole and ambient air surrounding the top surface of the sole.

7. A sole for an article of footwear according to claim 1, wherein the air tunnel comprises a front inlet for fresh air at a front side of the sole, the air tunnel conveying fresh air through the front air inlet and directing the fresh air to the top surface of the insole through the upwardly extending passageways.

8. The sole of an article of footwear according to claim 7, and further comprising:

an air bellows of greater diameter than the diameter of the air tunnel and positioned along said air tunnel at junctions between the air tunnel and the upwardly extending passageways, the bellows being sequentially inflated and collapsed when the sole is walked on so as to pump fresh air surrounding the front side of the sole through the sole and out through the top surface of the insole.

9. The sole of an article of footwear according to claim 7 further comprising:

means insertable in the front inlet of the air tunnel for allowing communication of air through the front inlet and into the air tunnel but restricting communication of liquid into the air tunnel through the front inlet.

* * * * *